US007708582B2

(12) United States Patent
Duval

(10) Patent No.: US 7,708,582 B2
(45) Date of Patent: May 4, 2010

(54) ELECTRICAL CONNECTOR

(75) Inventor: Frédéric Duval, de la Croix (FR)

(73) Assignee: Connecteurs Electriques Deutsch, Evreux (FR)

( * ) Notice: Subject to any disclaimer, the term of this patent is extended or adjusted under 35 U.S.C. 154(b) by 24 days.

(21) Appl. No.: 12/096,375

(22) PCT Filed: Dec. 4, 2006

(86) PCT No.: PCT/FR2006/002636

§ 371 (c)(1),
(2), (4) Date: Sep. 22, 2008

(87) PCT Pub. No.: WO2007/065988

PCT Pub. Date: Jun. 14, 2007

(65) Prior Publication Data

US 2009/0221173 A1 Sep. 3, 2009

(30) Foreign Application Priority Data

Dec. 6, 2005 (FR) ..... 05 12380

(51) Int. Cl.
*H01R 4/50* (2006.01)

(52) U.S. Cl. ..... 439/347

(58) Field of Classification Search ..... 439/347, 439/259, 345

See application file for complete search history.

(56) References Cited

U.S. PATENT DOCUMENTS

| | | | | |
|---|---|---|---|---|
| 4,915,648 | A | 4/1990 | Takase et al. | |
| 6,065,991 | A | 5/2000 | Fukuda | |
| 6,386,898 | B1 | 5/2002 | Taguchi | |
| 6,644,992 | B2 * | 11/2003 | Maegawa | 439/157 |
| 7,572,137 | B2 * | 8/2009 | Fekonja | 439/347 |
| 2007/0232116 | A1 * | 10/2007 | Bernat et al. | 439/347 |

FOREIGN PATENT DOCUMENTS

EP 1 156 557 A1 11/2001

* cited by examiner

*Primary Examiner*—Phuong K Dinh
(74) *Attorney, Agent, or Firm*—Young & Thompson

(57) ABSTRACT

The electric connector comprises a first plug-in or receiving part (2) and a second plug-in or male plug (3) which are electrically connectable by relatively translating the plugging parts (2, 3) along a connection axis (X) and is characterised in that said first plug-in part (2) is provided with first guiding means (16, 26) interacting with the second guiding means of the connection element (43) of the second plug-in part (3) in such a way that the connection element is enabled to be displaceable with respect to the first plug-in part, and said second plug-in part (3) comprises a box (33) provided with third guiding means interacting with said connection element (43) in such a way that the connection element is enabled to be displaceable with respect to the box along the connection axis (X) and elastic means generating the movement of the connection element with respect to the box.

11 Claims, 7 Drawing Sheets

ELECTRICAL CONNECTOR

The present invention has for its object an electrical connector.

The electrical connectors are at present utilized for various applications, for example for the connection of two electronic devices. For certain applications, the electrical connectors comprise interfacial sealing covers, disposed at the level of electrical contacts, which are adapted to ensure sealing between the plug-in portions of the connector. These interfacial sealing covers are effective only when sufficiently compressed. Their compression however requires the application of a substantial force during connection, which involves the use of special tools.

Moreover, the intervals of production tolerance can give rise to play between the plug-in parts, which can impede the locking and/or the connection of the plug-in parts as well as the interfacial sealing.

The present invention has for its object to provide an electrical connector which avoids at least certain of the mentioned drawbacks, which permits, despite tolerances, guaranteeing the interfacial sealing of the coupling, the connection and the locking, and which does not require a tool to carry out the connection and disconnection operations.

To this end, the invention has for its object an electrical connector comprising a first plug-in or base part and a second plug-in or plug, adapted to be electrically connected by relative translation of the plug-in parts along a connection axis, characterized in that said first plug-in part comprises first guide means adapted to coact with second guide means of a connection element of the second plug-in part, to permit relative displacement of the connection element with respect to the first plug-in part, between a release position, in which said connection element is free relative to said first plug-in part, and a locking position, in which said connection element is secured to said first plug-in part along the connection axis, said second plug-in part comprising a housing comprising a third guide means adapted to coact with the connection element to permit relative displacement of the connection element with respect to the housing along the connection axis, the second plug-in part comprising resilient means disposed between said housing and said connection element, and adapted, when said connection element is in locking position, to provide relative movement of the housing with respect to the connection element such that the housing moves in the direction of the first plug-in part along the connection axis.

Preferably, said housing has an overall parallelepipedal rectangular shape, said connection element having substantially a U shape, the central portion of the connection element extending transversely along a so-called upper wall of said housing, the two lateral portions of the connection element extending transversely along two opposite so-called lateral walls of the housing.

According to one embodiment of the invention, said first plug-in portion has an overall rectangular parallelepipedal shape, the second guide means including, on each lateral portion of the connection element, a projection which projects in the direction of the other lateral portion, the first guide means including, on two opposite so-called lateral walls of the first plug-in part, a recess defining on one of its edges a guide ramp, each projection being adapted to engage in the corresponding recess and to move into the recess along the guide ramp.

Preferably, the recess defines, in cooperation with an end of said corresponding guide ramp, a recess, the projection being held in position in said recess in the locked position.

Preferably, the second guide means include, on each lateral portion of the connection element, two projections which project in the direction of the other lateral portion, the two projections being aligned along an axis substantially perpendicular to the connection axis, the first guide means including, on two so-called lateral opposed walls of the first plug-in portion, two recesses, each recess defining on one of its edges a guide ramp, each projection being adapted to engage in the corresponding recess, and to move into the recess along the guide ramp.

According to one embodiment of the invention, the third guide means include a guide ramp projecting from the so-called upper wall of the housing, an edge of said central portion bearing against guide ramp, said central portion being adapted to move along said guide ramp.

Preferably, said guide ramp permits relative movement of the connection element with respect to the housing along the connection axis to permit the locking of the connection element on said first plug-in portion before the connection operation between the first plug-in part and the second plug-in part has concluded, which permits decreasing the connection force.

Preferably, the third guide means include, on each so-called lateral wall, a guide ramp, a corner of each lateral portion being in bearing relation against the corresponding guide ramp, each lateral portion being adapted to move along said corresponding guide ramp.

According to an embodiment of the invention, each lateral portion of the connection element comprises a guide groove extending along an axis substantially perpendicular to the connection axis, each so-called lateral wall of the housing comprising a flange adapted to engage in said corresponding guide groove with play along the connection axis, a blade forming a spring being disposed in each of said guide grooves and urging relative movement of the connection element with respect to the housing along the connection axis.

Preferably, after locking of the connection element on said first plug-in portion, the blades forming a spring ensure relative movement between the housing and the first plug-in portion to permit taking up the play along the connection axis.

According to an embodiment of the invention, each lateral portion comprises a recess adapted to receive one end of a helicoidal spring, the other end of said helicoidal spring being engaged in a recess in the corresponding so-called lateral wall, said spring being disposed along an axis substantially perpendicular to the connection axis to ensure relative movement along said axis substantially perpendicular to the connection axis of the connection element and of the housing, so as to move and hold the projection in the recess to ensure locking.

The invention will be better understood, and other objects, details, characteristics and advantages of the latter will become more clearly apparently, in the course of the detailed explanatory description which follows, of an embodiment of the invention given by way of purely illustrative and not limiting example, with reference to the accompanying schematic drawings.

Figure 1:
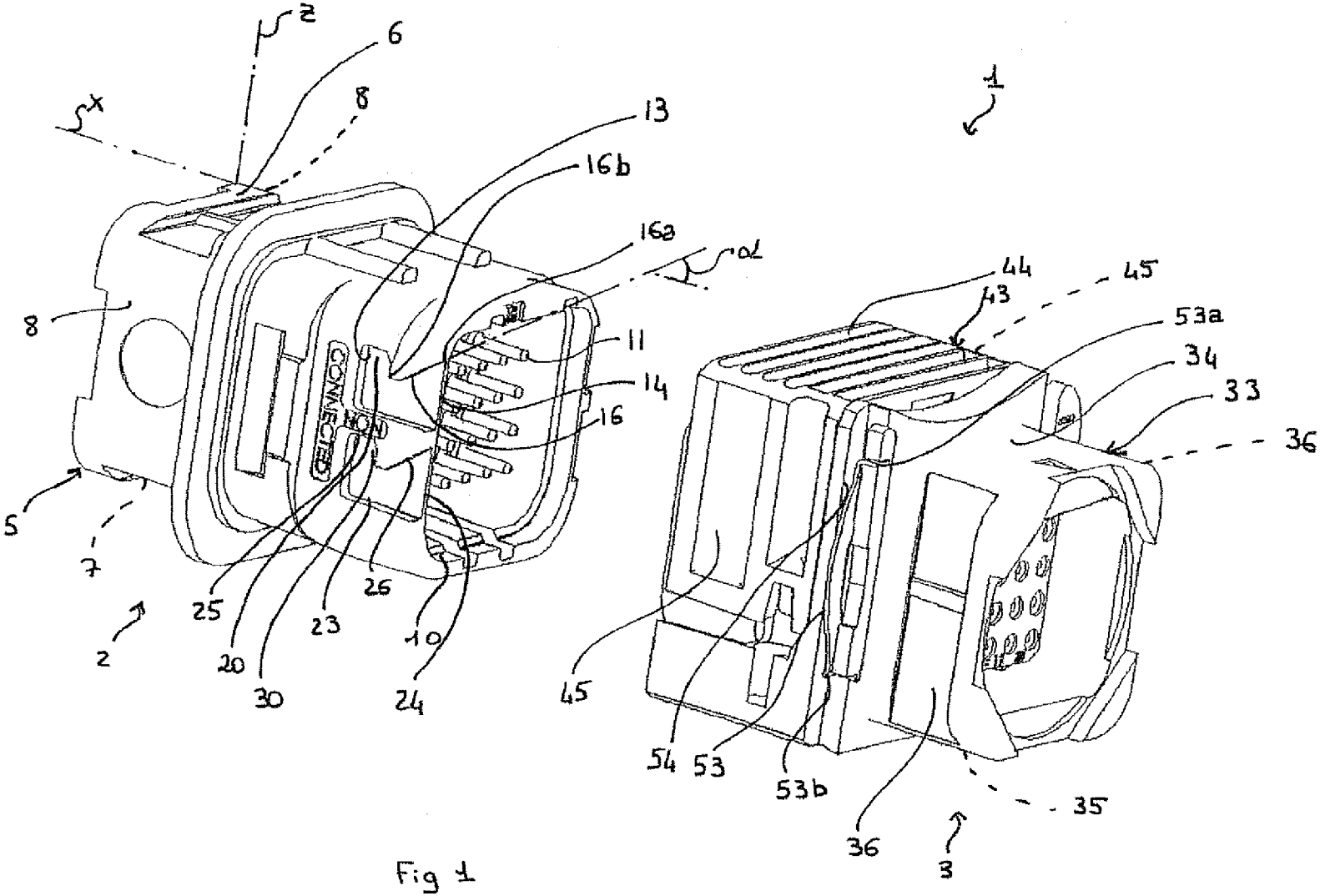
FIG. 1 is a schematic cross-sectional view, simplified and in perspective, of an electrical connector comprising a plug and a base according to an embodiment of the invention.
Figure 2:
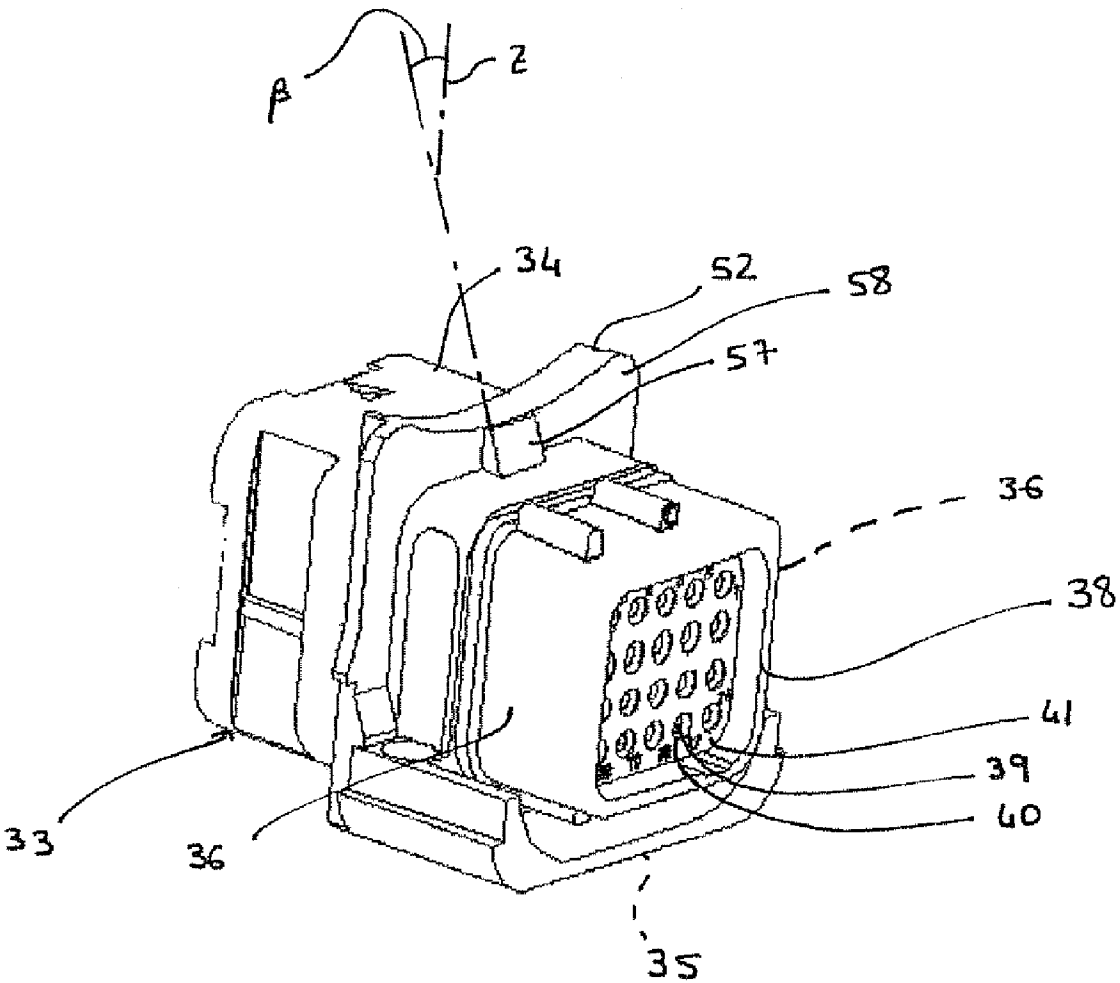
FIG. 2 is a schematic view, simplified and in perspective, of the housing and electrical contacts of the plug of FIG. 1.
Figure 3A:
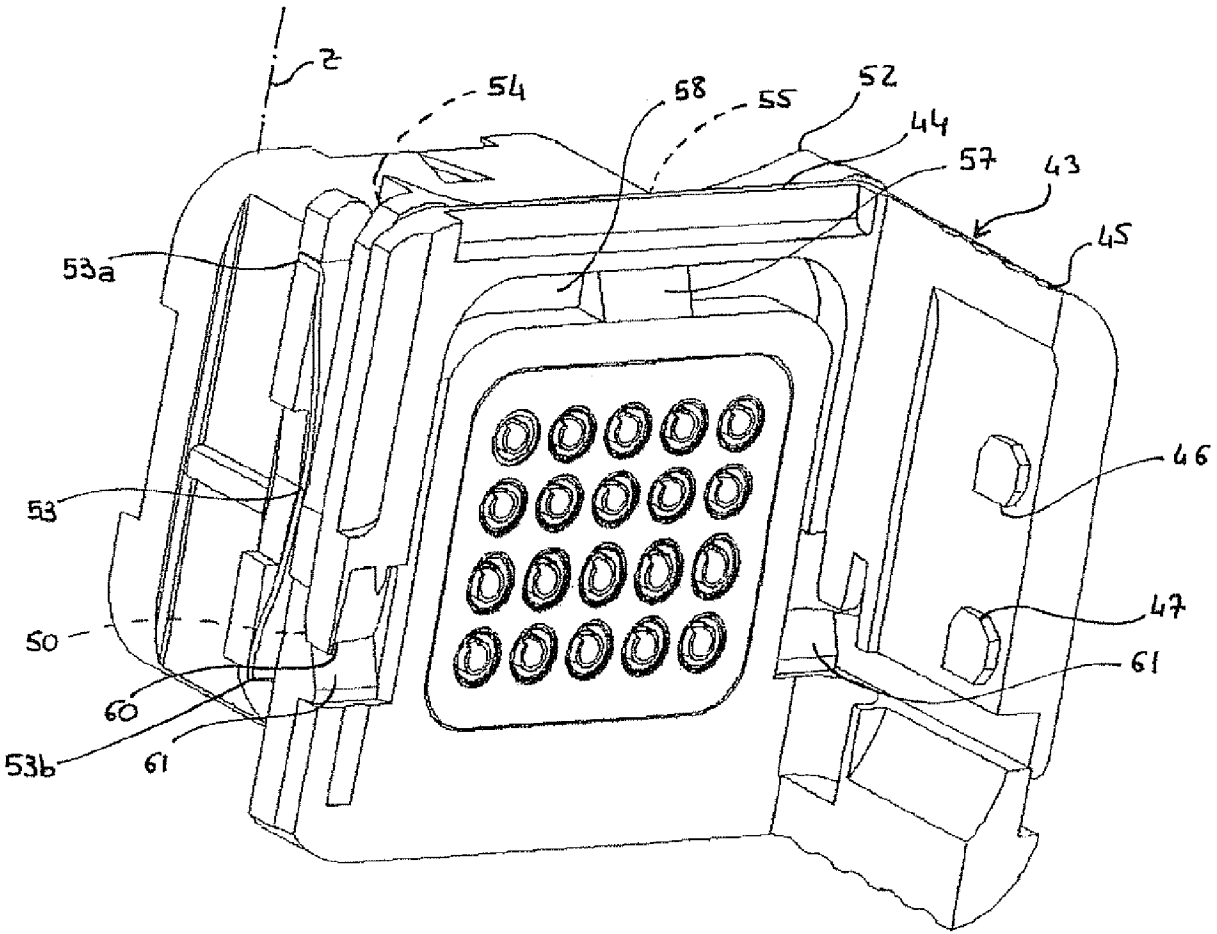
FIG. 3A is a fragmentary schematic view, simplified, and in perspective, showing a lateral portion of the stirrup and of the guide ramps of the plug of FIG. 1.
Figure 3B:
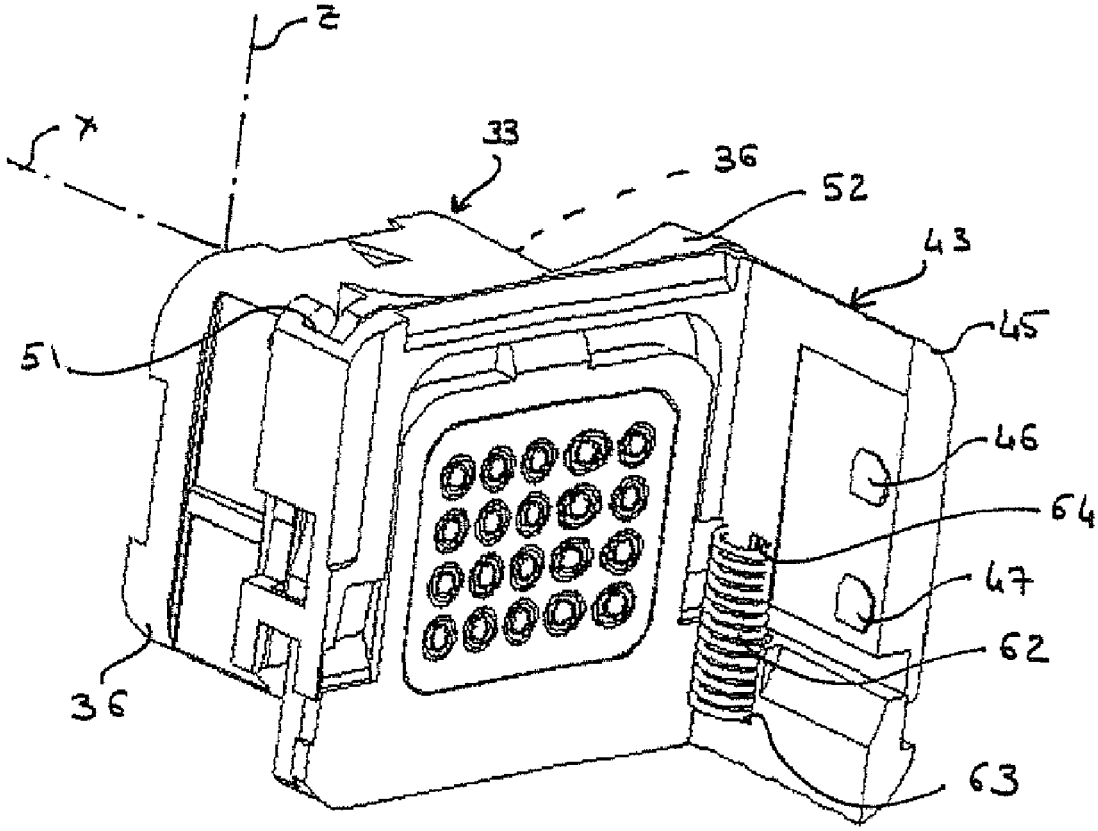
FIG. 3B is a view similar to FIG. 3A showing a guide groove of the stirrup.

With reference to FIG. 1, there will be seen a connector 1 comprising a first plug-in portion, called base 2, and a second plug-in portion, called plug 3. Base 2 is for example connected to an electronic device (not shown) integrated into an aircraft structure (not shown). The base 2 is fixed relative to the structure. The plug 3 is for example connected to a connector adapted to connect two pieces of electronic equipment (not shown). The base 2 and the plug 3 are adapted to be connected to each other by translation of the plug 3 relative to the base 2 in the connection direction X.

The base 2 comprises a housing 5 made for example of molded plastic or metal. The housing 5 has a generally rectangular parallelepipedal shape and comprises an upper wall 6, a lower wall 7 and two side walls 8. The front surface 10 of the housing 5 is open to permit access to the electrical contacts 11 distributed in four rows in the embodiment shown, the number of these rows not being limiting.

The electrical contacts 11 project from an interfacial sealing cover (not shown in FIG. 1) disposed in a transverse plane of the housing 5. The interfacial sealing cover is made of a sealing and deformable material, for example silicone. Each electrical contact 11 is surrounded by a projection (not shown in FIG. 1) of the interfacial sealing cover, substantially in the form of a chimney, projecting toward the front surface 10. In a manner known per se, the electrical contacts 11 are connected at their rear portion to a cable (not shown) or to an electrical circuit.

Each side wall 8 of the housing 5 comprises a recess 13, of which a lateral edge 14 is disposed in the plane of the front surface 10, and whose upper edge defines a guide ramp 16. One end 16*a* of the ramp 16 is disposed in the plane of the front surface 10. The ramp 16 is inclined downwardly, in a direction opposite the front surface 10, at an angle $\alpha$ relative to the axes X. For example, the angle $\alpha$ is substantially equal to 45°. The opposite end 16*b* of the ramp 16 opens into a recess 20 adapted to receive a lug of a stirrup, such as will be described in detail later on.

Each side wall 8 of the housing 5 comprises a second recess 23, similar to recess 13. The side edge 24 of the recess 23, disposed in the plane of the front surface 10, is offset along an axis Z, perpendicular to the axis X and parallel to the plane of the front surface 10, relative to the side edge 14. The upper edge 25 of the recess 23 defines a ramp 26 similar to ramp 16. The ramp 26 opens into a recess 30 adapted to receive a second lug of the stirrup.

Referring to FIGS. 1, 2, 3A and 3B, plug 3 comprises a housing 33 made for example of molded plastic or metal. The housing 33 has a generally rectangular parallelepipedal shape whose cross-section is adapted to the cross-section 5 of the base 2, such that the housing 33 of the plug 3 can be encased in the housing 5 of the base 2. The housing 33 comprises an upper wall 34, a lower wall 35 and two side walls 36.

The front surface 38 (FIG. 2) of the housing 33 is open to permit access to the electrical contacts 39 adapted to coact with the electrical contacts 11. The electrical contacts 39 are disposed in recesses 40 of substantially conical shape of a cover 41 disposed in a transverse plane of the housing 33. The cover 41 is for example made of plastic. In a manner known per se, the electrical contacts 39 are connected at their rear portion to a cable or to an electrical circuit (not shown).

The plug 3 comprises a connection element, called stirrup 43 (FIG. 1). The stirrup 43 has overall a U shape. The central portion 44 of the U is disposed substantially transversely along the upper wall 34 of the housing 33. The side portions 45 of the U extend transversely along side walls 36 of the housing 33.

Each portion 45 comprises two lugs 46 and 47 (FIGS. 3A and 3B), projecting toward the other portion 45, adapted to engage in recesses 20, 30, respectively, of the corresponding side wall 8. For purposes of clarity, only one portion 45 has been shown in FIGS. 3A and 3B.

Each portion 45 comprises a guide rail 51 disposed substantially along the axis Z. A flange 52 of the housing 33, projecting radially in a transverse plane of the housing 33, is inserted in the guide rail 51 with play, such that the connection between the guide rail 51 and the flange 52 permits displacement along the axis X of the stirrup 43 relative to the housing 33. A blade 53 of substantially parabolic shape forming a spring, which is for example made of metal, is disposed in the guide rail 51. The end 53*a* of the blade 53 is fixed to a wall of the guide rail 51. The end 53*b* of the blade 53 is disposed in a substantially parallel manner to the wall of the guide rail 51 and is adapted to slide relative to the wall of the guide rail. The central portion of the blade 53 bears against the rear surface 54 of the flange 52. The shape of the blades 53 permits raising the stirrup 43, as will be described in detail later.

The rear edge 55 of the central portion 44 of the stirrup 43 bears along a guide ramp 57 of the forward surface 58 of the flange 52 and is adapted to move along the guide ramp 57 during relative movement of the stirrup 43 with respect to the housing 33. The guide ramp 57 is inclined at an angle $\beta$ (FIG. 2) relative to the axis Z, such that, when the stirrup 43 carries out a movement of the axis Z in a direction opposite to the housing 33, the stirrup 43 will move simultaneously along the axis X in a direction opposite the forward surface 38 of the housing 33.

A lower corner 60 of the rear edge 50 of each portion 45 bears against a guide ramp 61 of the forward surface 58 of the flange 52 and is adapted to move along the guide ramp 61 during relative movement of the stirrup 43 with respect to the housing 33. The ramp 61 is inclined at the angle $\beta$ relative to the axis Z.

One end of a helicoidal spring 62 is disposed in a recess 63 for each side wall 36 of the housing 33, the opposite end of the spring 62 being disposed in a recess 64 of the portion 45 corresponding to the stirrup 43. The spring 63 turns to space the stirrup 43 from the housing 33 along the axis Z.

There will now be described a connection operation of the base 2 and the plug 3 according to the embodiment.

In the release position, which is to say when the lugs 46, 47 are not engaged in the ramps 16, 26, the return springs 62 press the stirrup 43 along the axis Z in a direction opposite to the housing 33 and the blades 53 press the stirrup 43 along the axis X in a direction opposite the front surface 38 of the housing 33. The stirrup 43 is in the upper position, which is to say that it bears against the upper portions of the ramps 57, 61.

Figure 4:
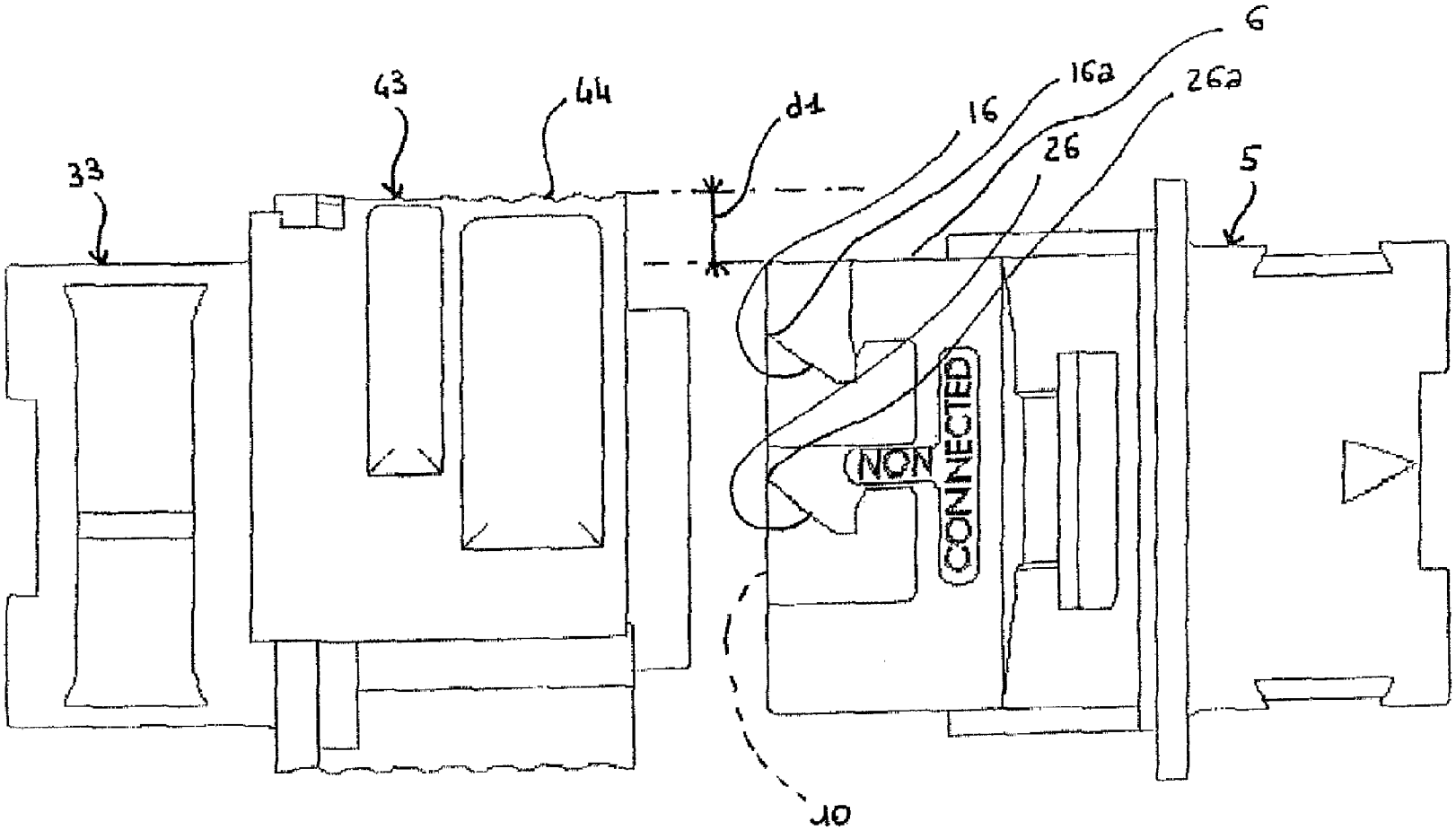
FIG. 4 is a simplified side schematic view of the plug and base of FIG. 1 in the disconnected position.

When, leaving this position, a user places the front surface 38 of the housing 33 of the plug 3 in line with the front surface 10 of the housing 5 of the base 2, such that the lugs 46, 47 will be located at the level of the ends 16*a*, 26*a* of the ramps 16, 26, the distance d1 (FIG. 4) between the upper wall 6 of the housing 5 of the base 2 and the portion 44 of the stirrup 43 is at a maximum, which corresponds to an upper position of the stirrup 43.

When, leaving this position, the user moves the plug 3 in the direction of the base 2 along the axis X, the lugs 46, 47 engage in the ramps 16, 26 then move along ramps 16, 26 compressing the springs 62. The distance between the upper wall 6 of the housing 5 and the base 2 and the portion 44 of the stirrup 43 decreases. It will be noted that the ramps 16, 26 permit an alignment and stability of the plug 3 and of the base 2 during the connection operation.

Simultaneously, the stirrup 43 moves along the ramps 57, 61. In other words, the stirrup 43 carries out, relative to the housing 33, a movement with 2 degrees of freedom, which is to say a translation along the axis X and a translation along the axis Z. This has the effect of amplifying the advance of the stirrup 43, which is to say that the movement of the housing 33 relative to thee housing 5 is less than the movement of the stirrup 43 relative to the housing 5. Thus, the penetration of the projections of the sealing cover into the recesses 40 of the cover 41 is limited, which reduces the force that the user must exert. In other words, the locking position is reached without requiring excess compression of the sealing cover. This permits decreasing the connection forces. The blades 53 compress and thus acquire the potential energy necessary for coupling the system to ensure thereafter the compression of the interfacial sealing cover of the base 2 and the cover 41, as will be described later in more detail.

Figure 5:
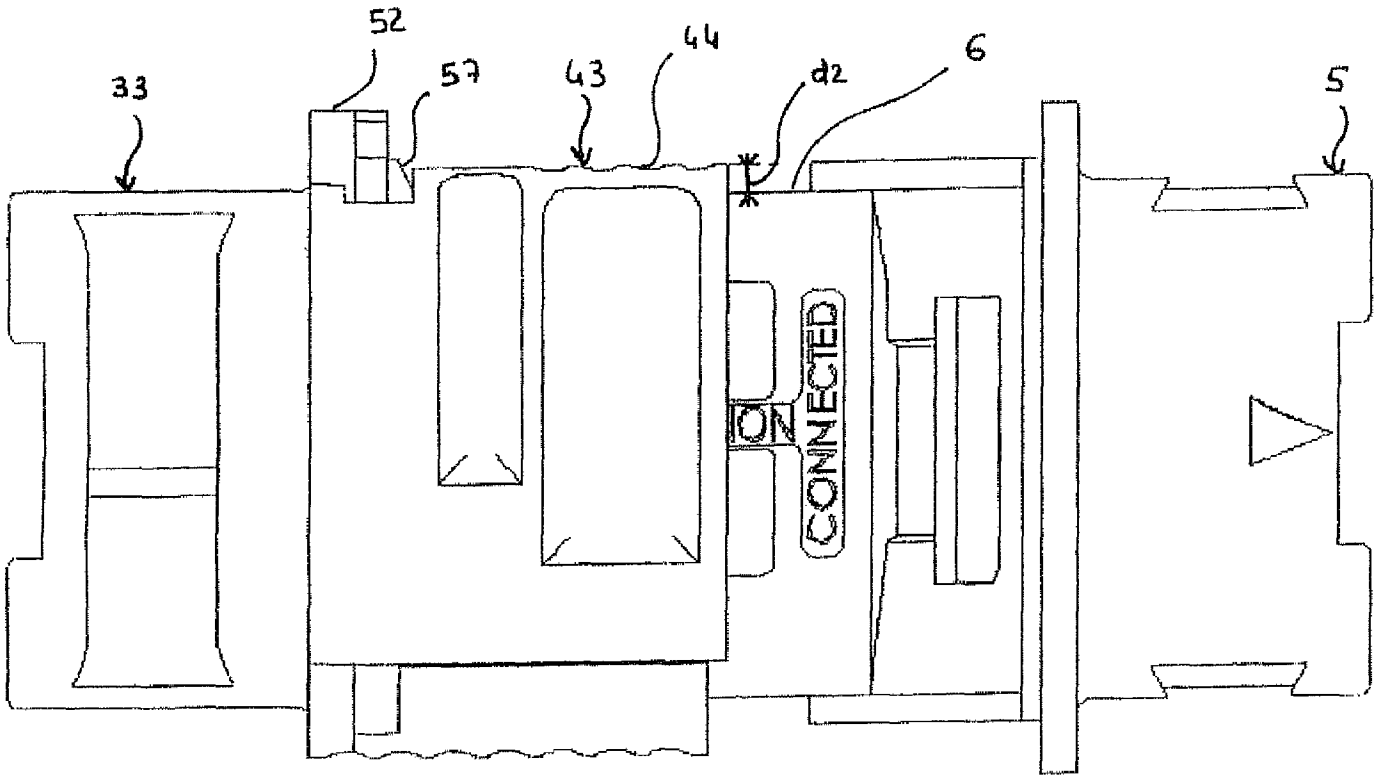
FIG. 5 is a view similar to FIG. 4 showing an intermediate position in the connection operation of the plug and the base.

When, leaving this position, the user continues to advance the plug 3 in the direction of the base 2 along the axis X, the lugs 46, 47 reach the ends 16*b*, 26*b* of the ramps 16, 26. This position is a critical locking position, in which the springs 62 and the blades 53 are stressed to the maximum. The ends 16*b*, 26*b* constitute hard points. The distance d2 between the central portion 44 and the upper wall 6 of the housing 5 is a minimum. The stirrup 43 is in the lower position (FIG. 5).

Figure 6:
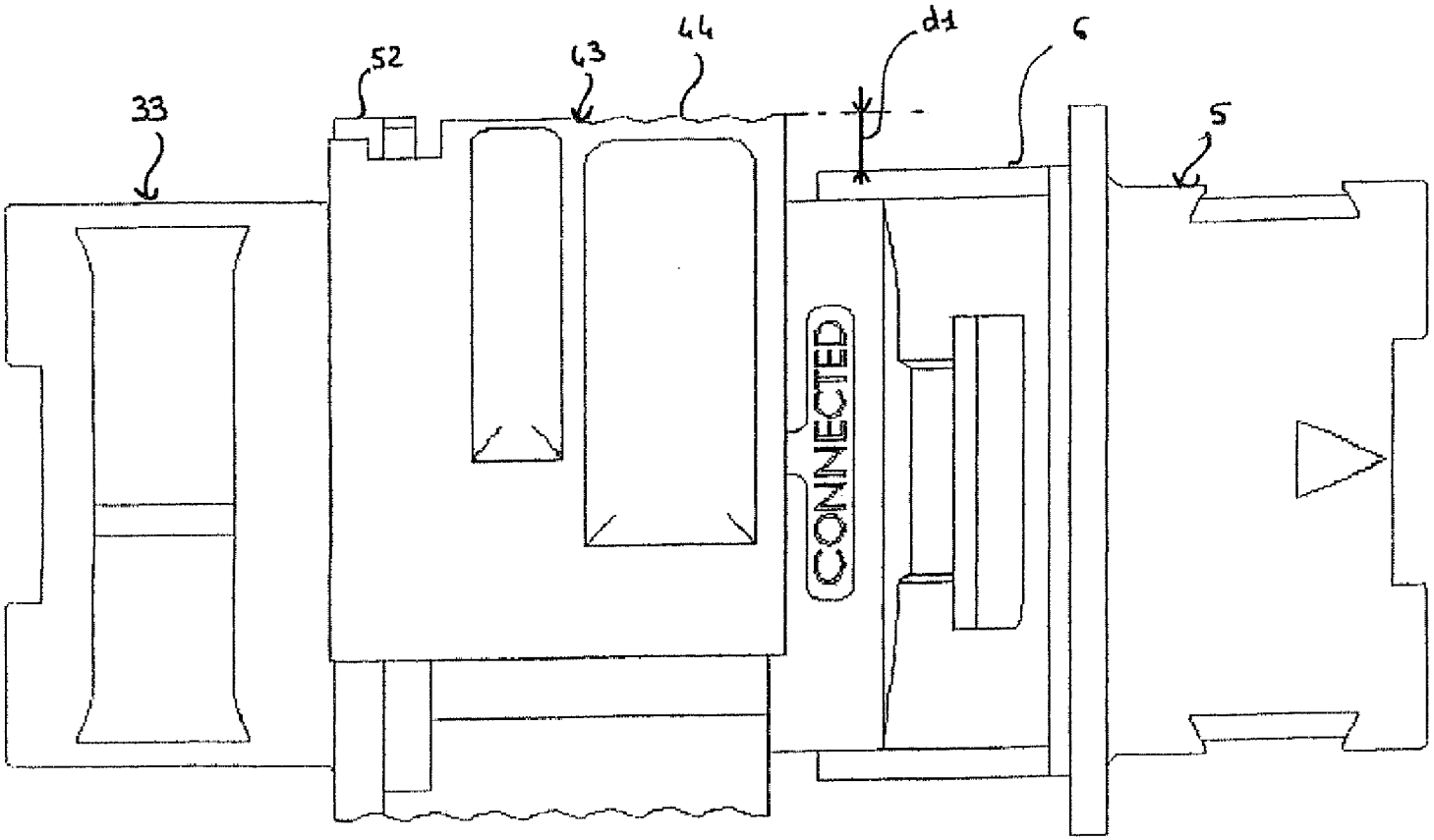
FIG. 6 is a view similar to FIG. 4 showing the plug and the base in connected position.

When the lugs 46, 47 have passed the ends 16*b*, 26*b* forming the end points, the springs 62 expand giving rise to movement of the stirrup 43 relative to the base 2 along the axis Z. The lugs 46, 47 engage in the recesses 20, 30. The stirrup 43 is located in a locking position in which it is secured to the housing of the base 2. The stirrup 43 is in the upper position (FIG. 6).

In this position, the blades 53 expand, which has the effect of giving rise to a force directed along the axis X which gives rise to movement of the housing 33 relative to the stirrup 43 along the axis X. The housing 33 moves relative to the housing 5 along the axis X in the direction of the housing 5.

During the connection operation, the projections of the interfacial sealing cover of the base 2 insert themselves by deformation into the conical recesses 40. The potential energy stored by the blades 53 ensures the coupling and the minimum compression of the interfacial sealing cover. The return force of the blades 53 balances the insertion force of the electrical contacts 11, 39 and the compression forces of the interfacial sealing cover. The return to equilibrium of the blades 53 thus permits ensuring the coupling between the base 2 and the plug 3 as well as the compression of the interfacial sealing cover.

The interfacial compression force is thus controlled during locking. This permits guaranteeing a minimum compression of the interfacial sealing cover. The minimal compression is the compression necessary to ensure interfacial sealing. The compression can give rise to a sufficient penetration distance of the projections of the interfacial sealing cover of the base 2 into the conical recesses 40. The minimal penetration distance is for example in the order of a tenth of a millimeter.

The blades 53 permit taking up play which can exist between the different pieces along the axis X. The connection operation thus permits guaranteeing interfacial sealing, the electrical connection and the locking, by controlling the forces, given the tolerance intervals, particularly during production, which can for example be of the order of a millimeter. This mechanism permits ensuring minimum compression of the interfacial cover despite the play which can exist between the different pieces.

There will now be described a disconnection operation of the base 2 and the plug 3 according to the embodiment.

When, leaving the locking position, a user exerts pressure on the stirrup 43 which returns it to the lower position, the lugs 46, 47 leave the recesses 20, 30. In this position, the plug 30 and the base 2 are no longer secured together and a movement along the axis X permits disconnection. In this position, when the user releases the stirrup 43, the stirrup 43 returns to its release position.

The connection and disconnection operations are carried out by manual action and do not require the use of a tool.

Other modifications are possible.

The connection can be an electrical connector of any type, and can be adapted for various applications. In particular, the shape of the housing of the base can be anything desired, the shape of the housing of the plug being adapted to permit connection of the base and the plug. The dimensions of the housing can be anything at all. The electrical contacts of the base can be male or female, the electrical contacts of the plug being adapted to permit the connection of the base and the plug.

The connection operation can be carried out by pushing on the stirrup 43. In this case, the user places the front surface 38 of the housing 33 in line with the front surface 10 of the housing 5 and pushes on the stirrup 43. When the lugs 46, 47 are located in line with the recesses 20, 30, the user releases the stirrup 43 and the lugs engage in the recesses 20, 30. It will be noted that in this modified connection operation, the lugs 46, 47 do not necessarily follow the ramps 16, 26.

The inclination of the ramps 16 and 26 can be different. For example the ramps 16, 26 can be upwardly inclined.

The base 2 is not necessarily fixed relative to a structure and the connection and disconnection operations can be carried out as the case may be by movement of one of the plug-in parts, the plug or the base, relative to the other plug-in part, the base or the plug respectively, or by simultaneous movement of the two plug-in portions.

The shape of the housings, the number of electrical contacts, and their arrangement can be anything at all.

A visual reference (shown in FIGS. 4 to 6) can permit the user to visualize in a simple way that the stirrup 43 is in the locked position. The visual reference can be provided on the housing 5 and comprises a word "NOT" disposed along the Z axis and a word "CONNECTED" disposed along the X axis. When the stirrup 43 moves along the X axis in the direction of the housing 5, it progressively masks the word "NOT". When the stirrup is disposed in the locking position or at least in line with the recesses 20, 30, the word "NOT" is completely masked, the word "CONNECTED" being visible. The visual reference permits particularly facilitating the connection operation for a non-professional user. The visual reference can also permit the user to determine when he must release the stirrup when the connection operation is carried out by pushing on the stirrup.

Although the invention has been described with reference to a particular embodiment, it is quite evident that it is not in any way limited and that it comprises all the technical equivalents and means described as well as their combination if these latter are within the scope of the invention.

The invention claimed is:

1. Electrical connector comprising a first plug-in portion or base (2) and a second plug-in portion or plug (3), adapted to be electrically connected by relative translation of the plug-in parts (2, 3) along a connection axis (X), characterized in that said first plug-in portion (2) comprises first guide means (16, 26) adapted to coact with second guide means (46, 47) of a connection element (43) of the second plug-in part (3), to permit relative movement of the connection element (43) with respect to the first plug-in part (2) between a release position, in which said connection element (43) is free relative to said first plug-in part, and a locked position, in which said connection element (46) is secured to said first plug-in part (2) along the connection axis (X), said second plug-in part (3) comprising a housing (33) comprising third guide means (57, 61) adapted to coact with the connection element (43) to permit a relative movement of the connection element (43) with respect to the housing (33) along the connection axis (X), the second plug-in part (3) comprising resilient means (53) disposed between said housing (33) and said connection element (43), and adapted, when said connection element (43) is located in a locked position, to urge relative movement of the housing (33) relative to the connection element (43) such that the housing moves in the direction of the first plug-in part (2) along the connection axis (X).

2. Connector according to claim 1, characterized in that said housing (33) has an overall rectangular parallelepipedal shape, said connection element (43) having substantially a U shape, the central portion (44) of the to connection element (43) extending transversely along a so-called upper wall (34) of said housing (33), the two lateral portions (45) of the connection element (43) extending transversely along two opposite so-called side walls (36) of the housing (33).

3. Connector according to claim 2, characterized in that said first plug-in part (2) has an overall rectangular paralellepipedal shape, the second guide means including, on each lateral portion (45) of the connection element (43), a projection (46) projecting in the direction of the other lateral wall (45), the first guide means including, on two opposite so-called lateral walls (8) of the first plug-in part (2), a recess (13) defining on one of its edges a guide ramp (16), each projection (46) being adapted to engage in the corresponding recess (13), and to move in the recess along the guide ramp.

4. Connector according to claim 3, characterized in that the recess (13) defines, in cooperation with one end (16*b*) of said corresponding guide ramp (16), a recess (20), the projection (46) being held in position in said recess (20) in the locking position.

5. Connector according to claim 3, characterized in that the second guide means include, on each lateral portion (45) of the connection element (43), two projections (46, 47) projecting in the direction of the other lateral portion (45), the two projections (46, 47) being aligned along an axis (Z) substantially perpendicular to the connection axis (X), the first guide means including, on two so-called opposite side walls (8) of the first plug-in part (2), two recesses (13, 23), each recess defining on one of its edges a guide ramp (16, 26), each projection (46, 47) being adapted to engage in the corresponding recess (13, 23) and to move into the recess along the guide ramp.

6. Connector according to claim 2, characterized in that the third guide means include a guide ramp (57) projecting from the so-called upper wall (34) of the housing (33), an edge of said central portion (44) bearing against said guide ramp (57), said central portion (44) being adapted to move along said guide ramp (57).

7. Connector according to claim 6, characterized in that said guide rail (57) permits relative movement of the connection element (43) with respect to the housing (33) along the connection axis (X) to permit locking the connection element (43) on said first plug-in part (2) before a connection operation between the first plug-in part (2) and the second plug-in part (3) is completed, which permits decreasing the connection force.

8. Connector according to claim 2, characterized in that the third guide means include, on each so-called lateral side wall (36), a guide ramp (61), a corner (60) of each lateral portion (45) bearing against the corresponding guide ramp (61), each lateral portion (45) being adapted to move along said corresponding guide ramp (61).

9. Connector according to claim 2, characterized in that each lateral portion (45) of the connection element (43) comprises a guide groove (51) extending along an axis (Z) substantially perpendicular to the connection axis (X), each so-called lateral side wall (36) of the housing (33) comprising a flange (52) adapted to engage in said corresponding guide groove (51) with play along the connection axis (X), a blade (53) forming a spring being disposed in each of said guide grooves (51) and urging relative movement of the connection element (43) relative to the housing (33) along the connection axis (X).

10. Connector according to claim 8, characterized in that, after locking of the connection element (43) on said first plug-in part (2), the blades (53) forming a spring ensure relative movement between the housing (33) and the first plug-in part (2) to permit taking up play along the connection axis (X).

11. Connector according to claim 2, characterized in that each lateral portion (45) comprises a recess (63) adapted to receive one end of a helicoidal spring (62), the other end of said helicoidal spring (62) being engaged in a recess (64) in the corresponding so-called lateral wall (36), said spring (62) being disposed along an axis (Z) substantially perpendicular to the connection axis (X) to ensure relative movement along said axis (Z) substantially perpendicular to the connection axis (X) of the connection element (43) and of the housing (33), so as to move and maintain the projection (46) into the recess (20) to ensure locking.

* * * * *